United States Patent [19]

Levasseur

[11] Patent Number: 4,991,740

[45] Date of Patent: Feb. 12, 1991

[54] VENDING MACHINE

[75] Inventor: Joseph L. Levasseur, Chesterfield, Mo.

[73] Assignee: Coin Acceptors, Inc., St. Louis, Mo.

[21] Appl. No.: 230,843

[22] Filed: Aug. 10, 1988

[51] Int. Cl.[5] ..... G07F 11/10

[52] U.S. Cl. ..... 221/114; 221/129

[58] Field of Search ..... 221/67, 114, 115, 126, 221/127, 129

[56] References Cited

U.S. PATENT DOCUMENTS

| | | | |
|---|---|---|---|
| 2,735,580 | 2/1956 | Galin et al. | 221/127 |
| 3,104,779 | 9/1963 | Denzer | 221/67 X |
| 3,110,417 | 11/1963 | Wingate et al. | 221/129 X |
| 3,467,275 | 9/1969 | Vaughan | 221/197 |
| 3,904,076 | 9/1975 | Payne | 221/67 |

*Primary Examiner*—F. J. Bartsuka

*Attorney, Agent, or Firm*—Cohn, Powell & Hind

[57] ABSTRACT

This vending machine includes a housing frame (12) subdivided into vertical columns (1–8) adapted to receive cylindrical articles (C). Elongate, rotatable support members (60) are provided below each column for supporting the column of articles, which tend to rotate under the weight of the articles. A ratchet wheel (70) and pawl member (80) assembly provided at one end of each support member provided a release mechanism controlling rotation of the support member incident to dispensing an article. The release mechanism associated with a selected column is actuated by one of a set of angularly related indexing members (101–108) carried by a drive shaft (100), each indexing member being disposed adjacent an associated pawl member. The drive shaft is driven by an electric motor (M) and the indexing members are rotated so that one of them is positioned to move an associated pawl member into and out of engagement with the ratchet wheel to dispense an article in response to customer selection.

7 Claims, 4 Drawing Sheets

FIG. 3.
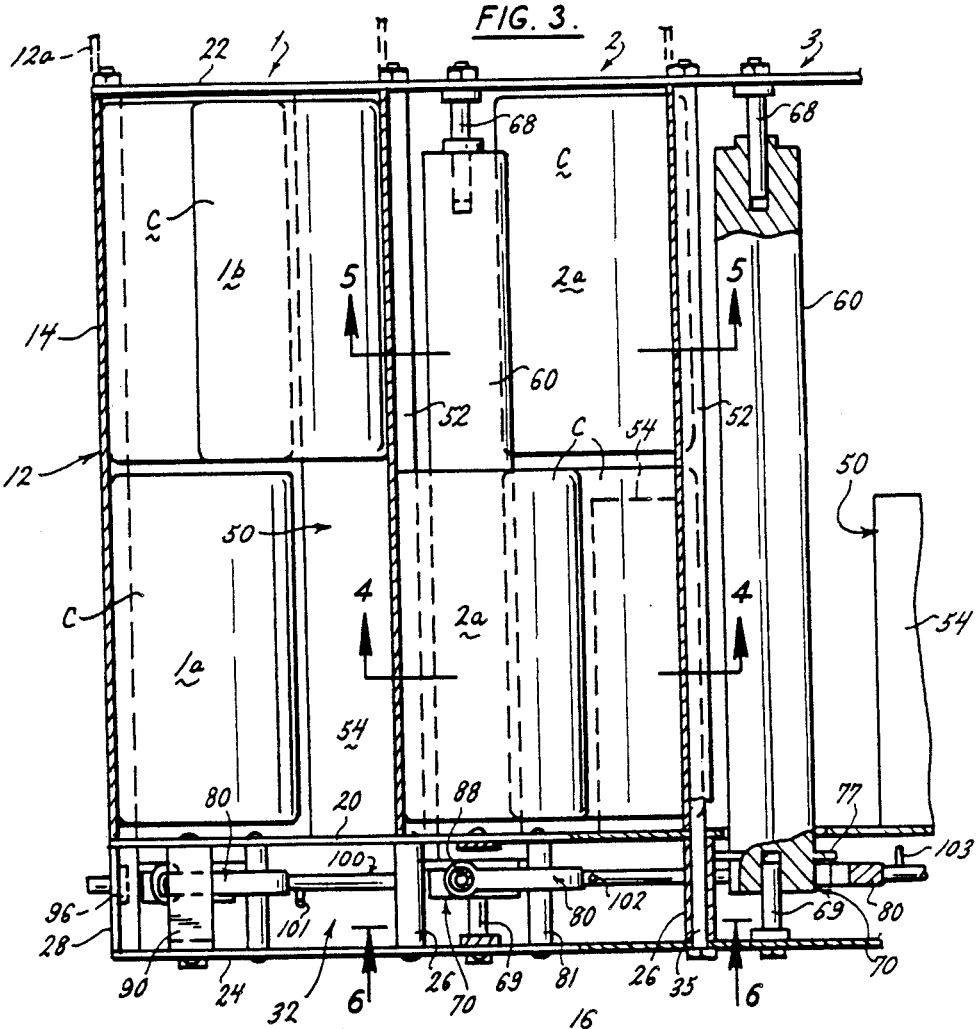
FIG. 9.
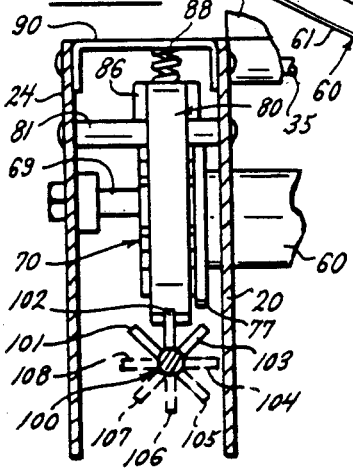
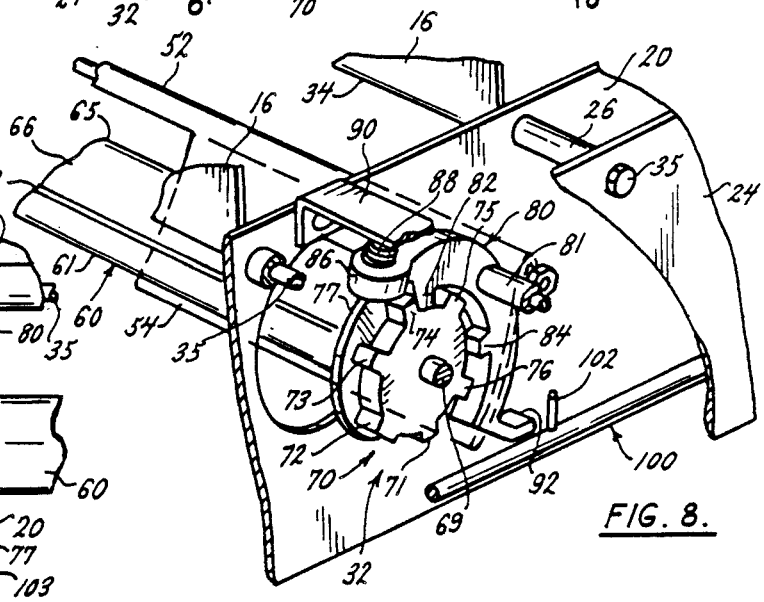
FIG. 8.

VENDING MACHINE

BACKGROUND OF THE INVENTION:

This invention relates generally to vending machines and particularly to an improved vending machine for dispensing cylindrical product containers such as bottles or cans in response to customer selections.

It is important in vending machines of the type under consideration to maximize storage capability and minimize the complexity of the delivery mechanism. The aim is that the product should occupy as much of the available interior space as possible thereby reducing overall size requirements.

A problem with many conventional machines is that they utilize a considerable number of switches and associated wiring as well as complicated delivery mechanisms. For example, multiple selection machines frequently rely on multiple solenoid operated delivery mechanisms. Not only do such switches and mechanisms consume valuable space but they render the machine susceptible to high maintenance costs.

Also important, with respect to efficient space utilization is the organization of the storage space. The simplest and most efficient storage lies in the use of vertical column loading but this often presents a problem because of the weight of the product. Accordingly, some machines utilize slant shelf arrangements or serpentine arrangements which reduces the gravity effect often at the expense of simplicity or storage space.

Conventional vending machines suffer from a lack of versatility in successfully allocating storage space for the anticipated product consumption for each selection. In some vending machines the problem is solved by simply providing additional columns to anticipated prime selections. Recent innovations have resulted in the use of diverting techniques which can result in some product being maintained in the machine for unreasonable lengths of time as well as increasing costs and decreasing reliability. While the application of anticipated use prediction techniques is desirable, the development of dispensing systems capable of utilizing these techniques has not been available.

The present vending machine solves these and other problems not disclosed in the known prior art.

SUMMARY OF THE INVENTION

This vending machine is provided with a dispensing mechanism which is ideally suited to utilize sophisticated anticipated use predicting techniques which reduce restocking and maintain product freshness and helps prevent depletion of popular selections.

This vending machine provides a particularly efficient product storage capability by reducing the space requirements for switching and delivery mechanisms. In this machine switching is virtually eliminated and the delivery mechanism is simplified by reducing the requirement for multiple electromagnet devices such as motors and solenoids to a minimum by utilizing common drive mechanisms.

The product storage capability is additionally enhanced by independent front and rear storage of the vertical columns.

It is an aspect of this invention to provide an article storage means including a plurality of substantially vertical columns disposed in side-by-side relation, each column being adapted to receive a plurality of vertically adjacent generally cylindrical articles; an elongate, rotatable support means disposed below each column and having a plurality of support elements, each support means having opposed ends and operatively supporting an article in a first position and tending to rotate to a second position under the weight of the article; release means including a ratchet means fixedly attached to one end of each support means and rotatable with said support means, and pawl means pivotally mounted adjacent said ratchet means to control rotation of the support means between the first and second position incident to releasing an article; actuating means for the release means including a drive shaft having a plurality of angularly related indexing members attached thereto, each indexing member being engageable with an associated pawl means, means for rotating said drive shaft so that selected indexing member is disposed adjacent a selected pawl means, means for inducing alternating motion into said drive shaft and indexing members so that said indexing member engages said pawl means to move said pawl means into and out of engagement with said ratchet means to permit rotation of said support means, and control means for the actuating means.

It is an another aspect of this invention to provide that the means for rotating said drive shaft is a first electric motor, and the means for inducing alternating motion into said drive means is a second electric motor including eccentric drive means and linkage means between said eccentric drive means and said drive shaft.

It is still another aspect of this invention to provide that the means for inducing alternating motion into said drive shaft is a solenoid.

Another aspect of this invention is to provide that the pawl means includes an end portion and means pivotally attaching said end portion to the other portion for one-way movement of said end portion relative to said other portion, and said actuating means includes means for oscillating said drive shaft and selected indexing member to induce said alternating motion into said indexing member.

Yet another aspect of this invention is to provide that each vertical column includes a first portion and a separate second portion, each column portion being adapted to receive a plurality of vertically adjacent, generally cylindrical articles, each rotatable support means includes independent portions having axially adjacent ends each independent portion supporting articles in said first and second column portions, and said release means includes a ratchet means at adjacent ends of each support portion and rotatable with its associated support portion and an associated pawl means, and said actuating means drive shaft indexing members are disposed between said pawl means to selectively actuate each of said ratchet means.

It is another aspect of this invention to provide that each release means includes a ratchet means fixedly attached to one end of an associated support means and rotatable with said support means, and pawl means pivotally mounted adjacent said ratchet means and movable into and out of engagement with said ratchet means to permit rotation of said support means.

Still another aspect of this invention is to provide that each ratchet means is integrally formed with its associated support means.

Another aspect of this invention is to provide that each support means has a three-pointed star configuration.

Yet another aspect of this invention is to provide that the axis of rotation of each support means is disposed within the associated substantially vertical column.

Still another aspect of this invention is to provide that each support means is formed from a bar having a substantially uniform cross section with a three-pointed star configuration and to provide that the ratchet means is a ratchet wheel integrally formed with said bar and having a plurality of ratchet teeth at equally spaced intervals, and to provide that the pawl means is an escapement member having spaced lug members sequentially engageable with said teeth.

Another aspect of this invention is to provide that each column includes a lower end and a member disposed at said lower end to narrow the exit and direct said articles onto said associated support means.

It is one aspect of this invention to provide that each vertical column includes a first portion and a second portion, each column portion being adapted to receive a plurality of vertically adjacent, generally cylindrical articles, each rotatable support means supports articles in said first and second column portions, and each of said first column portions includes an escrow member disposed below said support means and providing a hold position for delivering said articles in said first column portion sequentially with said articles in said second column portion, and to provide that each ratchet means includes six teeth.

It is an aspect of this invention to provide a vending machine which includes an article storage means including a plurality of storage compartments disposed in side-by-side relation, each compartment being adapted to receive a plurality of adjacent articles; a support means disposed at the end of each compartment and operatively supporting an article in a first position and tending to move to a second position under the weight of the article; release means controlling movement of the support means between the first and second position incident to releasing an article; actuating means for the release means including a drive shaft having a plurality of angularly related indexing members attached thereto, each indexing member being engageable with an associated release means, means for rotating said drive shaft so that a selected indexing member is disposed adjacent a selected release means, means for inducing alternating motion into said drive shaft and indexing members so that said indexing member engages and actuates said release means to permit movement of said support means, and control means for the actuating means.

BRIEF DESCRIPTION OF THE DRAWINGS

FIG. 3 is a plan view taken on line 3—3 of FIG. 1;

FIG. 8 is a perspective view of the release mechanism;

FIG. 9 is a cross sectional view taken on line 9—9 of FIG. 6;

DESCRIPTION OF THE PREFERRED EMBODIMENT

Figure 1:
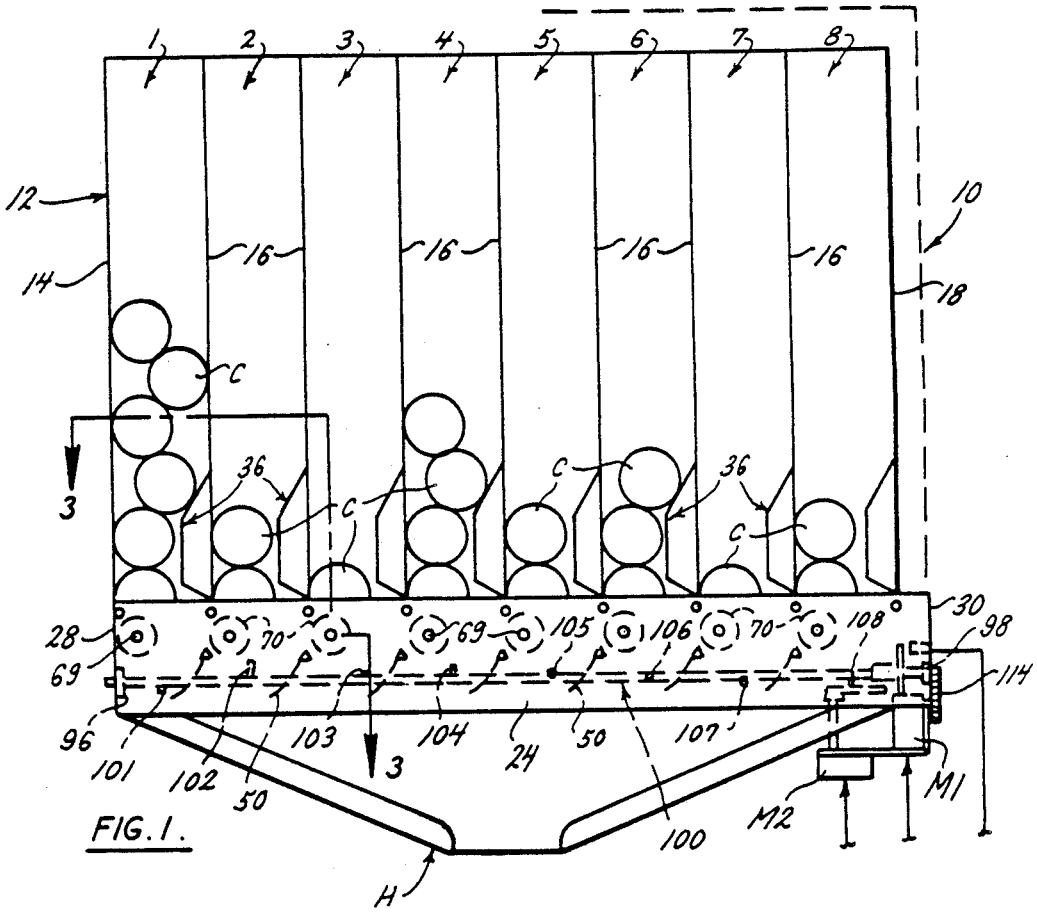
FIG. 1 is a schematic front view of the vending machine.

Referring now by reference numerals to the drawings and first to FIGS. 1 and 3 it will be understood that the vending machine 10 includes a frame 12 divided, in the embodiment shown, into eight storage compartments 1–8 by end walls 14 and 18 and intermediate partition walls 16. In the embodiment shown the compartments are substantially vertical. As shown in FIG. 3, the columns 1–8 are of sufficient depth to provide forward portions 1*a*, 2*a*, 3*a*, etc. and rearward portions 1*b*, 2*b*, 3*b*, etc. so that each column can accommodate two cylindrical articles or containers C such as cans or bottles, end to end. Each of the columns 1–8 is of sufficient width to accommodate staggered vertical rows of said containers C. The frame 12 also includes front and rear plates 20 and 22, connecting the partition walls 16; a front guard plate 24 spaced from said front plate 20, as by spacers 26, and side plates 28 and 30 which interconnect the rear plate 22 and the front guard plate 24. Plates 20 and 24 cooperate to provide a housing for the container release mechanism which is generally indicated by numeral 32 and will be described later.

Figure 4:
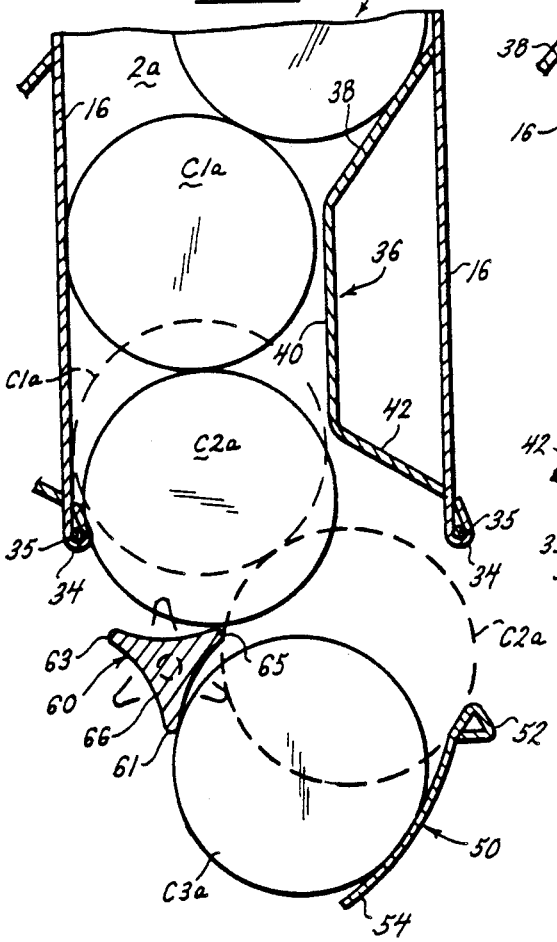
FIG. 4 is a cross sectional view taken on line 4—4 of FIG. 3 showing the delivery operation in a first column portion.
Figure 5:
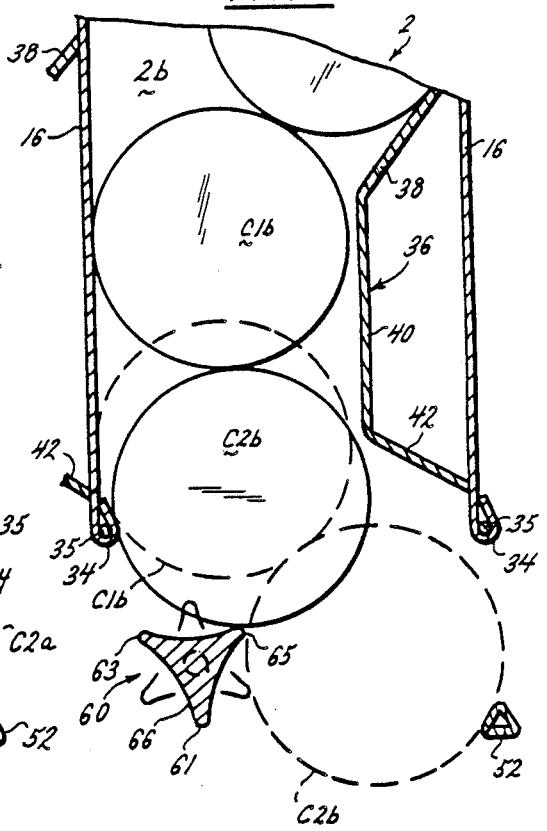
FIG. 5 is a cross sectional view taken on line 5—5 of FIG. 3 showing the delivery operation in a second column portion.

Referring now to FIGS. 4 and 5 it will be understood that partition plates 16 defining columns 1–8 are rolled at their lower end to provide a transverse bead 34 receiving elongate bolts 35, and that above the column exit defined by said beads, each of said plates 16 includes a transverse member 36, attached as by welding. The transverse members 36 effectively narrow the column and define the exit path of the containers C therein, said members 36 including an upper ramp portion 38, a vertical portion 40 and a lower inclined portion 42. Below the transverse member 36 is a retainer plate 50 which includes an upper portion 52, extending between and connected to front and rear plates 20 and 22 and, in the front portion of the column only, a curved escrow portion 54.

The containers are passed through the column exit by means of a three-point turnstile member 60 disposed below each column, which is axially supported in rotatable relation between the rear plate 22 and the guard plate 24 and cooperates with the retainer 50 to provide a turnstile system. In the embodiment shown the turnstile member 60, which is generally star-shaped in configuration, includes three points 61, 63 and 65 separated by concave surfaces 66 compatibly configurated to support a container C. The turnstile members 60 are mounted between the rear and guard plates 22 and 24 by stub shafts 68 and 69, respectively, in freely rotatable relation. The turnstile members provide support means for the containers and the axis of rotation of said members is disposed within the column and offset from weight center of the supported container. The result of this is that the turnstile members tend to rotate under the weight of the containers.

In the turnstile and retainer assembly shown in FIGS. 3–5, the three-point turnstile 60 extends through columns the front and rear columns, e.g. column portions 2*a* and 2*b* and each turnstile supports two containers C. The upper portion 52 of the retainer 50 also extends through the front and rear columns but the lower, escrow portion extends only through the front column portion 2*a*. Corresponding containers C1*a* and C1*b*, C2*a* and C2*b* in the front and rear column portions are axially aligned. The containers C1*a* and C1*b*, C2*a* and C2*b* and C3*a* are shown in full line representation in a first position, and in phantom outline representation in a second position. One hundred and twenty degrees (120° ) of movement of the turnstile member 60 are required to release a container C.

In FIGS. 4 and 5 the turnstile projection 65 holds containers C2*a* and C2*b* in the front and rear portions of column 2 in the position shown in full line representation. In FIG. 4 the turnstile projection 61 cooperates with the escrow portion 54 to hold container C3*a* in the position shown in full line representation.

When the turnstile member 60 is allowed to rotate sixty degrees (60°) to the position shown in phantom outline container C3*a* is delivered and containers C2*a* and C2*b* both move to the position shown in phantom outline in which they are supported by turnstile projection 65 and retainer member 52. When the turnstile member 60 is allowed to rotate a further sixty degrees (60°) container C2*a* will move into the position formerly occupied by container C3*a* and be held by the turnstile member 60 and cooperating escrow portion 54 in the front column portion. Container C2*b* however will be delivered since no escrow portion is provided in the rear column portion. Thus containers C are delivered alternately from each column portion for each sixty degrees (60°) of rotation of the turnstile member 60 but one hundred and twenty degrees (120°) of movement are necessary to deliver a container from the same column.

Figure 6:
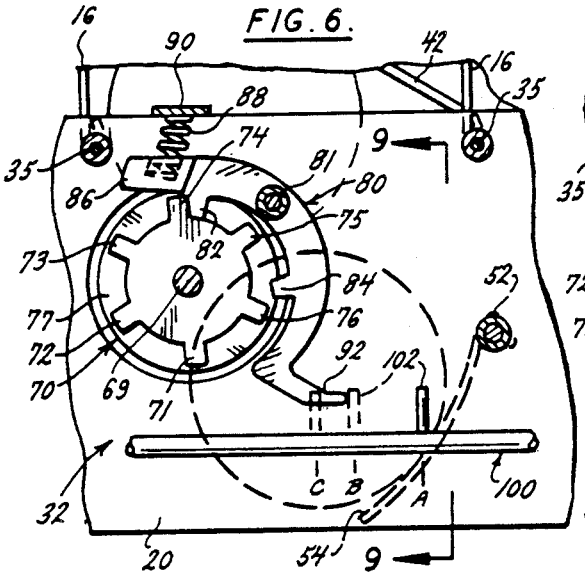
FIG. 6 is a front end view taken on line 6—6 of FIG. 3 showing the release mechanism in a holding position.
Figure 7:
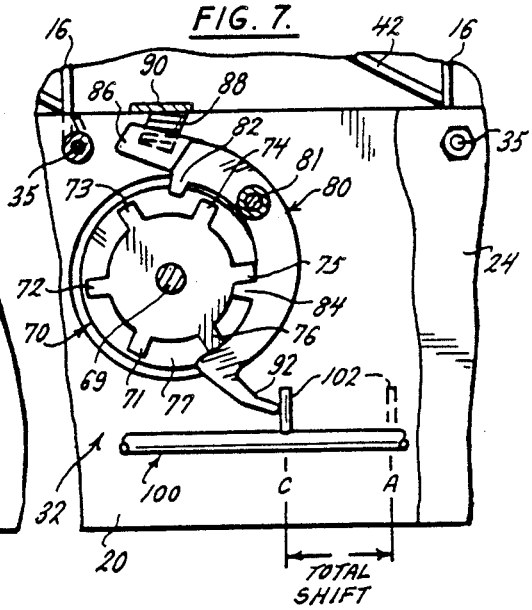
FIG. 7 is a similar view to FIG. 6 showing the release mechanism in a release position.

The release mechanism which controls the rotation of the turnstile member 60 from a first position, in which they are supported by the turnstile member to a second position incident to being dispensed will now be described with particular reference to FIGS. 6–8.

As shown in FIG. 8 each turnstile member 60 extends through the front plate 20 and is provided at its front end with a coaxially integrally mounted and integrally formed ratchet wheel 70 which rotates with the turnstile member 60. The ratchet wheel 70 includes a plurality of radially extending teeth 71–76, six (6) in number in the embodiment shown, and a circular back plate 77. An escapement member or pawl 80 is pivotally mounted adjacent the ratchet wheel 70 by a pivot shaft 81 extending between the front wall 20 and the guard wall 24. The escapement member 80 is generally arcuate and includes lugs 82 and 84 which are engageable respectively with the ratchet wheel teeth 74 and 76 in the position shown. At its upper end, the escapement member 80 includes a socket 86 providing a seat for the lower end of a spring 88 and said spring is engageable at its upper end with an abutment member 90 with the result that the lug 82 is biased into engagement with the uppermost tooth 74.

At its lower end the escapement member 80 includes an outstanding member 92, constituting a first engagement means which is engageable by a reciprocable member such as indexing pin 102 mounted to an elongate drive shaft 100, and constituting a second engagement means. In effect, the turnstile members and the release mechanism cooperate to block delivery of containers from the columns.

In the embodiment shown the drive shaft 100 is mounted between sidewalls 28 and 30. The shaft 100 includes a plurality of longitudinally spaced, radially outstanding pins 101 through 108 disposed in angular relation to each other about the shaft axis and constituting engagement means. As shown eight (8) pins are provided at equal angles of forty-five degrees (45°) each pin, such as pin 102, is selectively engageable with an associated adjacent escapement member 80. The shaft 100 is rotatable and shiftable so that the selected pin corresponding to a customer selection of a product in column 2, can be rotated into an upright position aligned with the escapement projecting member 92. The shaft 100 can then be shifted, as shown by reference to FIGS. 5 and 6, into and out of engagement with said member 92 to rotate ratchet wheel 70 and hence the turnstile member 60. Movement of the pin 102 from point A through engagement point B to point C pivots the escapement lug 82 out of engagement with the ratchet tooth 74 so that the turnstile member 60 rotates under the weight of a container C until the second tooth engages the second lug 84 as shown in FIG. 6. Return movement of the pin 102 from C to A results in reverse pivoting of the escapement member 80 under the biasing action of the spring 88 so that lug 82 engages the next tooth resulting in a total movement of the ratchet wheel 70 of approximately sixty degrees (60°).

In the embodiment shown a total movment of one hundred and twenty degrees (120°) is necessary to release a container C so that the front and rear containers in a column are released consecutively as the turnstile 60 and ratchet wheel 70 are rotated at sixty degree (60°) intervals.

The means by which the shaft 100 is rotated and shifted will now be described by reference to FIGS. 10 and 11 which are directed respectively to alternative arrangements for providing this movement.

Figure 10:
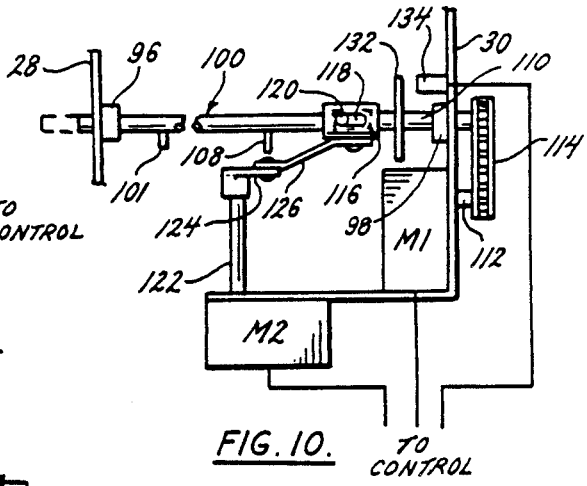
FIG. 10 is a partly schematic view of one form of drive mechanism.

In the embodiment shown in FIG. 10, the shaft 100 is carried by a bearing 96, mounted to wall 28, through which it can slide. At the other end the bearing is connected to an auxiliary shaft 110 parallel to the motor shaft 112 and driven from said motor by a drive chain assembly 114. The drive shaft 100 is connected to the auxiliary shaft 110 by means of a shaft coupler 116. The shaft coupler 116 includes a longitudinal slot 118 which receives a pin 120 fixedly attached to the auxiliary shaft 110. By this arrangement, the drive shaft 100 and attached coupler 116 can be shifted axially relative to the auxiliary shaft 110 while at the same time permitting rotation of said shaft 100 with said auxiliary shaft. The drive shaft 100 is shifted axially by means of a motor M2 which includes a motor shaft 122 having an eccentric arm 124 rotatable with said shaft 122 and connected to the coupler 116 by means of a pivoted link 126 and means not shown. As will be readily understood rotation of the arm 124 through three hundred and sixty degrees (360°) results in fore and aft movement of the drive shaft 100 equal to twice the radius of the arm 124.

Figure 2:
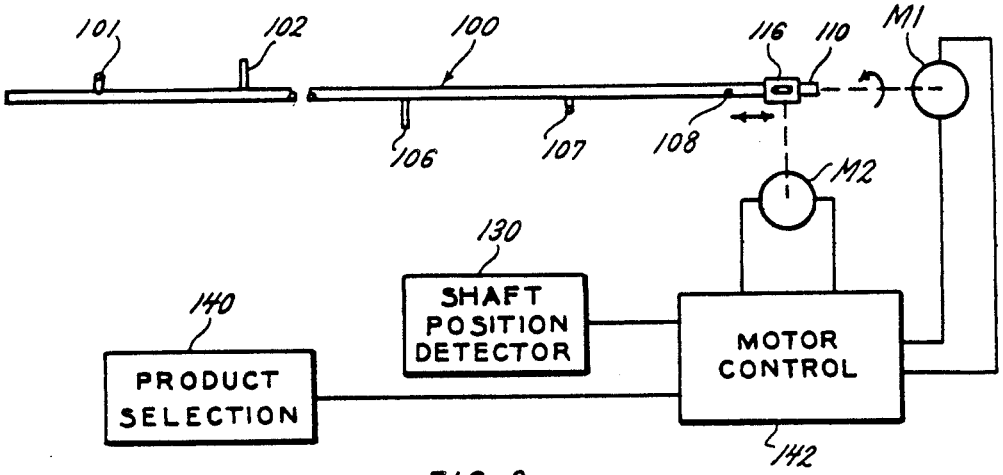
FIG. 2 is a block diagram showing the sequence of operations.

Rotation of the drive shaft 100 to its proper angular position so that a selected pin, e.g. pin 102, is conditioned to engage an escapement member 80 (FIG. 6) to initiate delivery of a container C, is achieved by a control means such as shown in FIG. 2. In the embodiment shown, the angular and axial position of the drive shaft 100 is provided by a Shaft Position Detector 130 to which information is fed by means of cooperating encoder elements 132 and 134 (FIG. 10). This encoding means can be provided by photo-optic, magnetic or other well known position detection means. The indication of the desired product to be vended is provided by the Product Selector 140. The motors Ml and M2 (which can be AC, DC or stepper type motors) are actuated in accordance with information input to a Motor Control 142 by the Product Selector 140 and the Shaft Position Detector 130.

Figure 11:
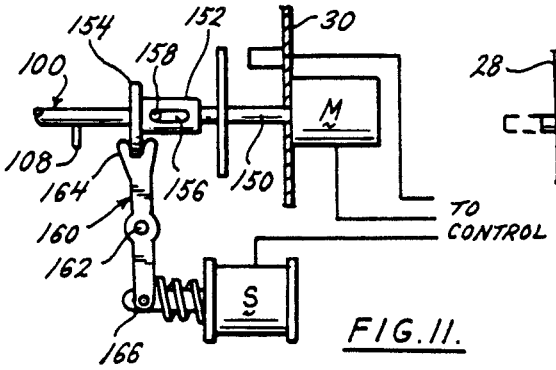
FIG. 11 is a similar view of a modified drive mechanism.

In the embodiment shown in FIG. 11 the shaft 100 is connected to the shaft 150 of a motor M mounted to the wall 30 by means of a shaft coupler 152. The shaft coupler 152 includes a disc flange 154 and the coupler includes a slot 156 which receives a pin 158 fixedly attached to the motor shaft 150. The drive shaft 100 is shifted axially by means of a positioning lever 160, which is pivotally mounted to the housing by pivot shaft 162 intermediate its ends. At its upper end 164 the lever is bifurcated to receive the flange 154 and at its lower end 166 the shaft is pivoted to the core of a solenoid S. Reciprocating movement of the shaft 100 and pins 101–108 from a first position to a second position and back again is experienced when the solenoid S is energized and de-energized. A similar control means is provided to that discussed above with respect to the embodiment described above with respect to FIG. 10.

In the preferred embodiment the electronic control system utilizes a microprocessor but can also be implemented using logic gate circuitry.

Figure 12:
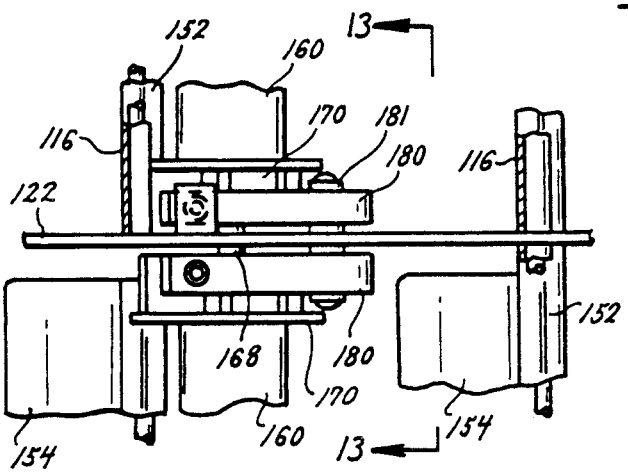
FIG. 12 is a fragmentary view of a modified release mechanism for a double unit.
Figure 13:
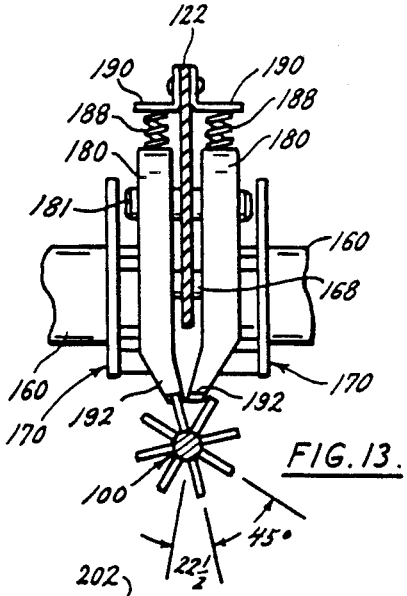
FIG. 13 is a cross sectional view taken on line 13—13 of FIG. 12.

In some instances it may be desirable to provide a second double unit, such as indicated in phantom outline in FIG. 3 by 12*a*, where additional product is required. In such an arrangement a total of four (4) column portions are provided. In this event, in lieu of providing an entirely independent second release system, a compound release system can be used as indicated in FIGS. 12 and 13. As shown turnstile members 160 are provided on each side of a partition wall 122, which are independently rotatable on a common shaft 168. A six-tooth ratchet wheel 170 is provided at the end of each turnstile member 160 and individual escapement members 180 are pivotally mounted to partition wall 122 by a common pivot shaft 181. The turnstile members 160 and ratchet wheels 170 are substantially identical with those discussed above. The escapement members 180 are substantially identical except for the inwardly turned lower portions carrying the projecting member 192. This arrangement permits the use of a single rod 100 having appropriate pins 101–108, in lieu of two independent rods. The control system is modified in order to provide for double usage.

Figure 14:
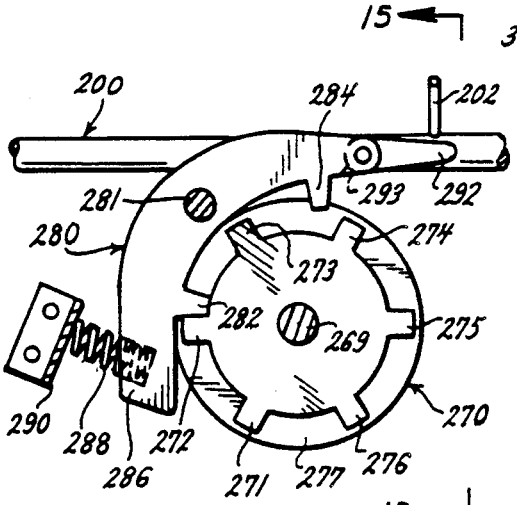
FIG. 14 is a front end view of another modified release mechanism.
Figure 15:
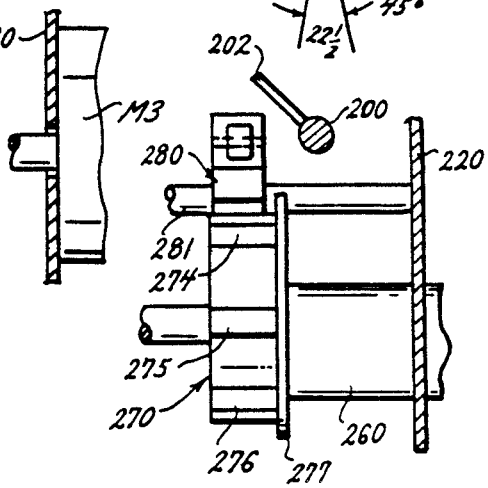
FIG. 15 is a view taken on line 15—15 of FIG. 14.

A modified release mechanism is shown in FIGS. 14 and 15 which utlizes a reversible drive motor and requires no shifting mechanism. In this embodiment the ratchet wheel 270 and the turnstile member 260 are substantially identical to those described above. However, the escapement member 280 is different in that it includes a pivoted finger 292 which is upwardly movable relative to the other portion of the escapement member 280 but is precluded from moving downwardly relative to said other portion by virtue of a pivot stop 293. The drive shaft 200 is driven by a reversible motor M3 and like the previous embodiment includes a plurality of pins 201–208 which however are longer. When the shaft is rotated clockwise all pins lift their associated pivot fingers 292. A selected pin, e.g. pin 202, is disposed in close adjacency to its associated pivot finger 292 and counterclockwise motion of the shaft 200 rotates pin 202 downwardly which pushes the finger 292 downwardly together with the escapement member 280 which pivots and the result of this is that the engagement lug 282 pivots out of engagement with ratchet tooth 272 so that the turnstile member 260 rotates under the weight of a container C until lug 284 engages with ratchet tooth 273. Clockwise motion induced into the shaft 200 causes the end of the escapement member 280 carrying the pivot finger 292 to move upwardly under the action of spring 288 so that lug 284 moves out of engagement with ratchet tooth 273 and lug 282 moves into engagement with ratchet tooth 271. Thus the oscillating movement of the pin 202 causes a total rotation of the ratchet wheel 270, and the turnstile member 260 of one hundred and twenty degrees (120°). In other respects the operation is similar to that described above. It will be understood that the length of the pins 201–208 and the angular oscillatory motion are chosen so that only one pin engages its associated pivot finger at any one time.

With respect to the loading of the forward and rearward portions of the columns, it will be understood that the forward portions are front loaded while the rearward portions are top loaded.

It will be understood that the term "vending machine" used herein is intended to include both cash and credit merchandising machines.

Several embodiments of the vending machine have been described above in detail and those skilled in the art will appreciate that modifications may be made without departing from the spirit of this invention. For example, it will be readily understood that the angular relationship of forty-five degrees (45°) attained by using eight pins is not intended as a limitation, since more or less pins can be used as desired to suit the number of columns. Other modifications are possible, for example the compartments could be inclined rather than vertical. Therefore, it is not intended that the scope of the invention be limited to the specific embodiments illustrated and described. Rather, it is intended that the scope of this invention be determined by the appended claims and their equivalents.

I claim as my invention:

1. A vending machine, comprising:

(a) article storage means including a plurality of substantially vertical columns disposed in side-by-side relation, each column being adapted to receive a plurality of vertically adjacent generally cylindrical articles, (b) an elongate, rotatable support means disposed below each column and having a plurality of support elements, each support means having opposed ends and operatively supporting an article in a first position and tending to rotate to a second position under the weight of the article, (c) release means including a ratchet means fixedly attached to one end of each support means and rotatable with said support means, and pawl means pivotally mounted adjacent said ratchet means to control rotation of the support means between the first and second position incident to releasing an article, (d) actuating means for the release means including:

1. a drive shaft having a plurality of angularly related indexing members attached thereto, each indexing member being engageable with an associated pawl means, 2. means for rotating said drive shaft so that a selected indexing member is disposed adjacent a selected pawl means, 3. means for inducing alternating motion into said drive shaft and indexing members so that said indexing member engages said pawl means to move said pawl means into and out of engagement with said ratchet means to permit rotation of said support means, and (e) control means for the actuating means, (f) the pawl means including an end portion and means pivotally attaching said end portion to the other portion for one-way movement of said end portion relative to said other portion, and (g) said actuating means including means for oscillating said drive shaft and selected indexing member to induce said alternating motion into said indexing member.

2. A vending machine, comprising:

(a) article storage means including a plurality of substantially vertical columns disposed in side-by-side relation, each column being adapted to receive a plurality of vertically adjacent generally cylindrical articles, (b) an elongate, rotatable support means disposed below each column and having a plurality of support elements, each support means having opposed ends and operatively supporting an article in a first position and tending to rotate to a second position under the weight of the article, (c) release means including a ratchet means fixedly attached to one end of each support means and rotatable with said support means, and pawl means pivotally mounted adjacent said ratchet means to control rotation of the support means between the first and second position incident to releasing an article, (d) actuating means for the release means including:

1. a drive shaft having a plurality of angularly related indexing members attached thereto, each indexing member being engageable with an associated pawl means, 2. means for rotating said drive shaft so that a selected indexing member is disposed adjacent a selected pawl means, 3. means for inducing alternating motion into said drive shaft and indexing members so that said indexing member engages said pawl means to move said pawl means into and out of engagement with said ratchet means to permit rotation of said support means, and (e) control means for the actuating means, (f) each vertical column including a first portion and a separate second portion, each column portion being adapted to receive a plurality of vertically adjacent, generally cylindrical articles, (g) each rotatable support means including independent portions having axially adjacent ends each independent portion supporting articles in said first and second column portions, and (h) said release means including a ratchet means at adjacent ends of each support portion and rotatable with its associated support portion and an associated pawl means, and said actuating means drive shaft indexing members being disposed between said pawl means to selectively actuate each of said ratchet means.

3. A vending machine, comprising:

(a) article storage means including a plurality of substantially vertical columns disposed in side-by-side relation, each column being adapted to receive a plurality of vertically adjacent generally cylindrical articles, (b) an elongate, rotatable support means disposed below each column and having a plurality of support elements, each support means having opposed ends and operatively supporting an article in a first position and tending to rotate to a second position under the weight of the article, (c) a plurality of release means including a ratchet means fixedly attached to one end of each support means and rotatable with said support means, and pawl means pivotally mounted adjacent said ratchet means to control rotation of the support means between the first and second position incident to releasing an article, (d) actuating means for the plurality of release means including:

1. a drive shaft extending between said ratchet means and having a plurality of angularly related indexing members attached thereto, each indexing member being engageable with an associated pawl means, 2. means for rotating said drive shaft so that a selected indexing member is disposed adjacent a selected pawl means, 3. means for inducing alternating motion into said drive shaft and indexing members so that said indexing member engages said pawl means to pivot said pawl means into and out of engagement with said ratchet means to permit rotation of said ratchet means and said support means, and (e) control means for the actuating means, (f) each vertical column including a first portion and a second portion, each column portion being adapted to receive a plurality of vertically adjacent, generally cylindrical articles, (g) each rotatable support means supporting articles in said first and second column portions, and (h) each of said first column portions including an escrow member disposed below said support means and providing a hold position for delivering said articles in said first column portion sequentially with said articles in said second column portion each support means having a multi-star configuration and each ratchet means including a plurality of teeth at least twice as many in number as the points on the support means and cooperting with the escrow means to sequentially release the articles.

4. A vending machine as defined in claim 3, in which:

(i) each support means has a three-pointed star configuration and each ratchet means includes six teeth.

5. A vending machine, comprising:

(a) article storage means including a plurality of generally aligned first and second storage compartment portions disposed in side-by-side relation, each compartment portion being adapted to receive a plurality of adjacent articles, (b) support means disposed at the end of each compartment and operatively supporting an article in a first position and tending to move to a second position under the weight of the article, each support means having a multi-pointed star configuration and supporting an article in a first and second compartment portion, (c) a plurality of release means controlling movement of the support means between the first and second position incident to releasing an article each release means including a ratchet wheel having a plurality of circumferentially disposed teeth and a pawl means, said ratchet teeth being at least twice as many in number as the points on the support means, (d) actuating means for the plurality of release means including:

1. a drive shaft extending between said ratchet wheels and having a plurality of angularly related indexing members attached thereto, each indexing member being engageable with an associated pawl means,
2. means for rotating said drive shaft so that a selected indexing member is disposed adjacent a selected pawl means,
3. means for inducing alternating motion into said drive shaft and indexing members so that said indexing member engages and actuates said pawl means to permit movement of said support means, and (e) control means for the actuating means, and (f) an escrow member disposed below said support member and said first column portion and providing a hold position for delivering said articles in said first compartment portion sequentially with said articles in said second compartment portion.

6. A vending machine as defined in claim 5, in which:

(g) each pawl means is an escapement member having spaced lug members sequentially engageable with said teeth whereby as one lug moves outwardly out of tooth-engagement the other lug moves inwardly into an incipient tooth engagement position to provide a stop to accurately determine the amount of rotation of said support means.

7. A vending machine as defined in claim 6, in which:

(h) each support means has a three-pointed star configuration and each ratchet wheel includes six teeth.

* * * * *